United States Patent [19]

Vroome

[11] Patent Number: 4,526,159

[45] Date of Patent: Jul. 2, 1985

[54] FIREPLACE GRATE

[76] Inventor: Ray L. Vroome, 43 Lawson Dr., Madison, Conn. 06443

[21] Appl. No.: 617,602

[22] Filed: Jun. 5, 1984

[51] Int. Cl.[3] ..... F23H 13/00

[52] U.S. Cl. ..... 126/164; 126/298

[58] Field of Search ..... 126/164, 336, 165, 163 R, 126/152 R, 152 A, 152 B, 120, 121, 9 B, 298; 211/120, 60 R, 60 A

[56] References Cited

U.S. PATENT DOCUMENTS

| | | | |
|---|---|---|---|
| 1,273,840 | 7/1918 | Fassett | 126/9 B |
| 3,838,679 | 10/1974 | Welch | 126/165 |
| 4,058,108 | 11/1977 | Dahlquist | 126/165 |
| 4,441,481 | 4/1984 | Verhaegen | 126/164 |
| 4,463,747 | 8/1984 | Parton | 126/164 |

FOREIGN PATENT DOCUMENTS

| | | | |
|---|---|---|---|
| 428430 | 5/1935 | United Kingdom | 126/165 |

*Primary Examiner*—James C. Yeung

*Attorney, Agent, or Firm*—Brady, O'Boyle & Gates

[57] ABSTRACT

A fireplace grate having a base, an inclined heat radiating back wall detachably connected to the base, and an inclined wire grill, positioned forwardly of the back wall, detachably connected to the base and adjustable relative to the back wall; the space between the grill and back wall forming a cradle for receiving a single row of vertically stacked logs.

10 Claims, 3 Drawing Figures

FIREPLACE GRATE

BACKGROUND OF THE INVENTION

The most efficient fireplaces are those constructed and arranged to radiate heat back into the room in which the fireplace is located. To accomplish this, it has been proposed to line the fireplace walls with a heat reflecting material such as stainless steel. While this arrangement has been satisfactory for its intended purpose, it is relatively expensive and wasteful since the logs are usually stacked two or three high and two or three deep so that the radiation from the logs in back is blocked by those in the front; thus, the excess logs merely provide the heat required to sustain the fire.

It has been found that to obtain the maximum radiation from each burning log, the logs should be stacked vertically in a single row; that is, one log deep, so that the fresh logs are on top, the burning logs in the middle, and hot coals dropping to the bottom. Grates or log supports designed to accomplish this are heavy, expensive and have failed to provide the proper draft and heat concentration necessary to make the fire reliably self-sustaining.

After considerable research and experimentation, the fireplace grate of the present invention has been devised to provide a simple, lightweight, inexpensive log holder which is easily assembled and provides the maximum radiated heat per pound of wood by supporting the logs and hot embers or coals in a vertical plane to provide a surface area perpendicular to the direction of radiation.

The fireplace grate of the present invention comprises, essentially, a base, an inclined heat radiating back wall detachably connected to the base, and an inclined wire grill, positioned forwardly of the back wall, detachably connected to the base, and adjustable relative to the back wall, whereby the space between the grill and back wall forms a cradle for receiving a single row of vertically stacked logs.

DESCRIPTION OF THE PREFERRED EMBODIMENT

Figure 1:
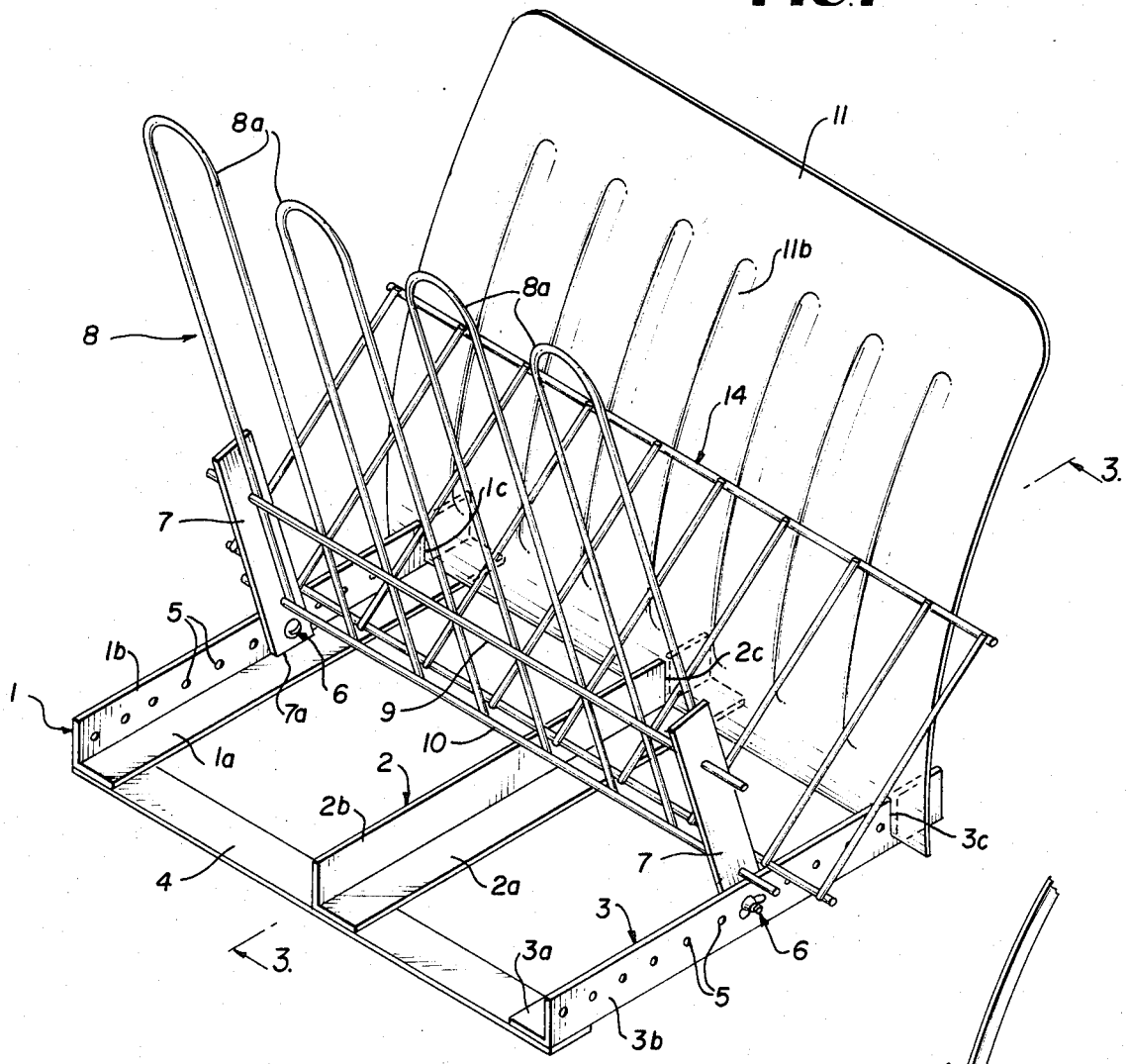
FIG. 1 is a perspective view of the fireplace grate of the present invention.
Figure 2:
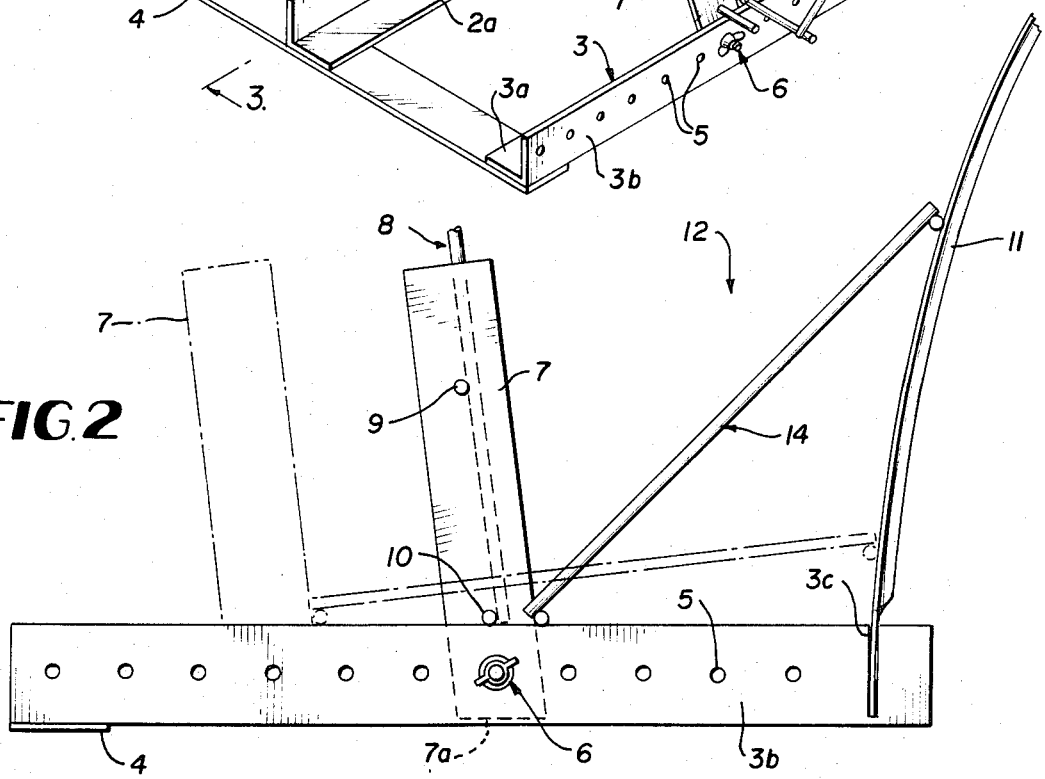
FIG. 2 is a side elevational view of the grate showing the wire grill, in phantom, being adjusted forwardly of the back wall.

Referring to the drawings, and more particularly to FIGS. 1 and 2 thereof, the fireplace grate of the present invention comprises a base including a plurality of horizontally disposed angle irons 1, 2 and 3 held in parallel, spaced relationship to each other by a transversely extending frame member 4 attached to the respective horizontal legs 1*a*, 2*a*, 3*a* of the angle irons. The vertical legs 1*b*, 3*b* of the outboard angle irons 1 and 3 are provided with a plurality of apertures 5 adapted to receive a bolt and wing nut assembly 6 extending through an aligned aperture provided in the lower ends of an inclined mounting plate 7. The inclination of the mounting plates 7 is obtained by cutting the lower end 7*a* of each plate on a bias and supporting the end of the mounting plate on the horizontal legs 1*a* and 3*a* of the angle irons 1 and 3.

The mounting plates 7 are employed for supporting a wire grill 8 in an inclined position relative to the base. While the wire grill may be formed in various configurations, the grill of the present invention comprises a plurality of spaced, reversely bent wire portions 8*a* interconnected at their lower end portions by a pair of spaced, parallel, transversely extending rods 9 and 10, the ends of the rods 9 and 10 extending through suitable apertures provided in the mounting plates 7.

Figure 3:
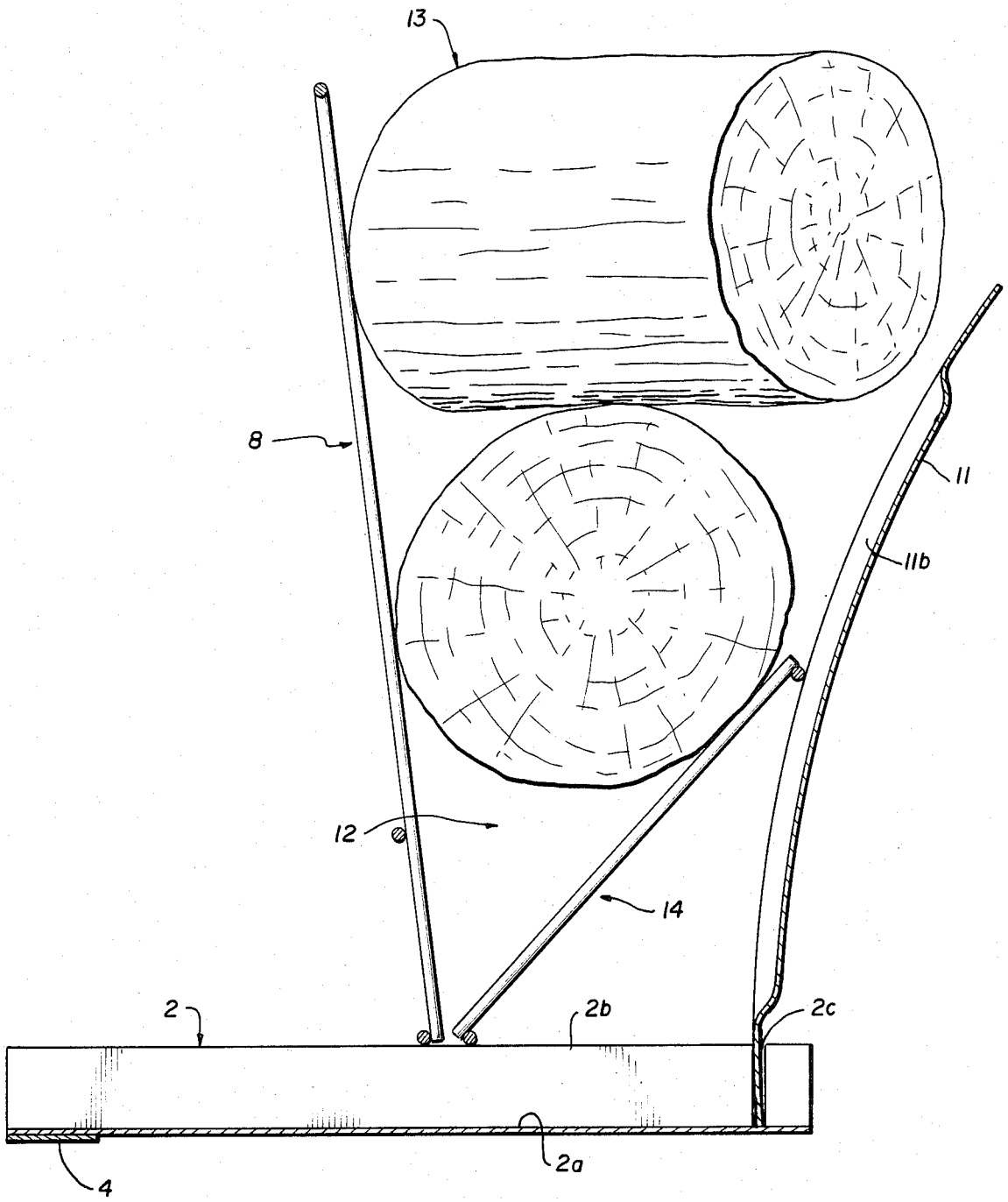
FIG. 3 is a view taken along line 3—3 of FIG. 1 showing a single row of vertically stacked logs in the grate.

To complete the basic structure of the grate, an inclined back plate 11 is spaced rearwardly from the wire grill 8, and the lower edge portion thereof is inserted into suitable slots 1*c*, 2*c*, 3*c* provided in the angle irons 1, 2 and 3, whereby the back plate 11 is held in the operative position. The space 12 between the wire grill 8 and back plate 11 forms a cradle for receiving a single row of vertically stacked logs 13, as shown in FIG. 3. A suitable draft of air for supporting the combustion of the logs is provided by the space formed by the floor of the fireplace in which the grate is mounted and the vertical legs 1*b*, 2*b*, 3*b* of the angle irons, and also grooves 11*b* formed in the back plate 11.

The lowermost log can rest on the top edges of the vertical legs 1*b*, 2*b*, 3*b* of the angle irons 1, 2, 3, or, to increase the draft area, a rectangular grid 14 can be freely mounted in an inclined position within the space 13, as shown in FIG. 3 for supporting the lowermost log. If the grid 14 is not desired, it is merely removed and the lowermost log will rest on the top edges of the vertical legs 1*b*, 2*b*, 3*b* of the angle irons.

To assemble the fireplace grate of the present invention, the lower edge portion of the back plate 11 is inserted into the slots 1*c*, 2*c*, 3*c* formed in the vertical legs of the angle irons 1, 2 and 3, respectively. The wire grill 8 and associated mounting plates 7 are secured to the vertical legs 1*b* and 3*b* of the angle irons 1 and 3 by the wing nut assemblies 6 extending through a selected aperture 5 in the vertical legs 1*b* and 3*b*, the particular aperture being selected depending upon the diameter of the logs to be burned. Thus, for relatively large diameter logs, the grill 8 would be positioned as shown in phantom in FIG. 2 to provide a wide space 12 between the grill 8 and back plate 11. To accommodate smaller logs, the grill 8 would be mounted as shown in solid lines in FIG. 2, to thereby provide a smaller space 12 for receiving the logs. If the grid 14 is to be used, it is placed in an inclined position in the space 12 with one side of the grid resting on the top edges of the vertical legs 1*b*, 2*b*, 3*b* of the angle irons and abutting the edges of the support plates 7, while the other side of the grid 8 abuts the back plate 11, to thereby provide an inclined surface for supporting the lowermost log as shown in FIG. 3.

In use, the grate is placed in a fireplace with the base supported on the fireplace floor with the back plate 11 resting against the fireplace back wall. The logs 13 are placed in the space 12 between the grill 8 and back plate 11, the logs being stacked vertically in a criss-cross fashion to form a single row, that is, one log deep, whereby the fresh logs will be on top, the burning logs will be in the middle, and the hot embers or coals will drop to the bottom. This arrangement of the logs minimizes the depth of the fire and maximizes the radiation from each burning log, the radiation being enhanced by the hot back plate 11 concentrating the heat into the burning area. A draft for the fire is provided by either the angle irons 1, 2 and 3 or the grid 14 supporting the lowermost log above the fireplace floor, and the inclined back plate 11 deflecting the draft upwardly through the burning logs. By supporting the logs above the fireplace floor, removal of the accumulated ashes from the bottom is also facilitated.

If the grate is not to be used for an extended period of time, it can be easily dismantled for storage by lifting the back plate 11 out of the angle iron slots 1*c*, 2*c*, 3*c*, and removing the wing nut assemblies 6 to disconnect the wire grill 8 from the angle irons 1 and 2.

From the above description, it will be readily understood that the fireplace grate of the present invention provides a simple, lightweight, inexpensive log holder which is easily assembled and insures a reliable, self-sustaining fire which is easily started and maintained, while providing efficient radiation from a minimum of wood burned.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A fireplace grate comprising, a base having a plurality of horizontally disposed angle irons, each angle iron having a horizontal leg and a vertical leg, a transversely extending frame member connected to the horizontal legs of said angle irons for holding said angle irons in parallel, spaced relationship to each other, a heat radiating back wall detachably connected to said base, a wire grill detachably connected to said base and positioned forwardly of the back wall, whereby the space between the back wall and the grill is adapted to receive a single row of vertically stacked logs, and a mounting plate positioned adjacent the vertical leg of each outboard angle iron, the end of each mounting plate abutting the horizontal leg of its respective angle iron and the side surface of each mounting plate abutting the surface of the vertical leg of the respective angle iron, said grill being connected to said mounting plates.

2. A fireplace grate according to claim 1, wherein the back wall and grill are inclined in a divergent direction with respect to each other to thereby form a cradle for receiving the stacked logs.

3. A fireplace grate according to claim 1, wherein the end of each mounting plate is cut on a bias whereby the mounting plates and associated grill are inclined relative to the base.

4. A fireplace grate according to claim 3, wherein the grill comprises a plurality of spaced, parallel, vertically extending, reversely bent wire portions, and a pair of spaced, parallel, transversely extending rods rigidly connected to the lower end portions of said reversely bent wire portions, the ends of said rods extending through said mounting plates.

5. A fireplace grate according to claim 1, wherein a plurality of apertures are provided in the vertical legs of the outboard angle irons, detachable fastener means extending through the lower end portions of the mounting plates and a selected aperture in the vertical legs of the outboard angle irons, whereby the space between the grill and the back wall can be varied to accommodate logs of various diameters.

6. A fireplace grate according to claim 1, wherein a vertically extending slot is provided in each vertical leg of said angle irons, the lower edge portion of said back wall being freely received in said slots, whereby the back wall is detachably connected to the base.

7. A fireplace grate according to claim 6, wherein a plurality of grooves are formed in the back wall to enhance the draft through the grate.

8. A fireplace grate according to claim 1, wherein a rectangular grid is freely mounted in an inclined position within the space between the grill and back wall for supporting the lowermost log.

9. A fireplace grate according to claim 8, wherein one side of the grid rests on the top edges of the vertical legs of the angle irons and abuts the edges of the support plates, the other side of said grid abutting said back wall.

10. A fireplace grate comprising, a base, a heat radiating back wall detachably connected to said base, a wire grill detachably connected to said base and positioned forwardly of the back wall, whereby the space between the back wall and the grill is adapted to receive a single row of vertically stacked logs, the back wall and grill being inclined in a divergent direction with respect to each other, to thereby form a cradle for receiving the stacked logs, and a rectangular grid freely mounted in an inclined position within the space between the grill and back wall for supporting the lowermost log above the fireplace floor, whereby the draft of air for supporting the combustion of the logs is enhanced and the removal of accumulated ashes is facilitated.

* * * * *